US008313588B2

(12) United States Patent
Iorio et al.

(10) Patent No.: US 8,313,588 B2
(45) Date of Patent: Nov. 20, 2012

(54) AMORPHOUS MAGNETIC ALLOYS, ASSOCIATED ARTICLES AND METHODS

(75) Inventors: Luana Emiliana Iorio, Clifton Park, NY (US); Francis Johnson, Clifton Park, NY (US); Pazhayannur Ramanathan Subramanian, Niskayuna, NY (US); Gary Shiflet, Charlottesville, VA (US); Joseph Poon, Charlottesville, VA (US); Sriparna Bhattacharya, Charlottesville, VA (US)

(73) Assignee: General Electric Company, Niskayuna, NY (US)

( * ) Notice: Subject to any disclaimer, the term of this patent is extended or adjusted under 35 U.S.C. 154(b) by 452 days.

(21) Appl. No.: 12/609,391

(22) Filed: Oct. 30, 2009

(65) Prior Publication Data

US 2012/0067468 A1 Mar. 22, 2012

(51) Int. Cl.
*C22C 45/02* (2006.01)

(52) U.S. Cl. ..... 148/304; 148/403

(58) Field of Classification Search ..... None
See application file for complete search history.

(56) References Cited

U.S. PATENT DOCUMENTS

| | | | | |
|---|---|---|---|---|
| 7,132,019 | B2 * | 11/2006 | Koshiba et al. | 148/304 |
| 7,918,946 | B2 * | 4/2011 | Sato | 148/304 |
| 2007/0175545 | A1 * | 8/2007 | Urata et al. | 148/304 |

FOREIGN PATENT DOCUMENTS

| | | |
|---|---|---|
| JP | 2008024985 | 2/2008 |
| JP | 2008248380 | 10/2008 |
| WO | WO-2008/105135 A1 * | 9/2008 |

OTHER PUBLICATIONS

European Search Report dated Oct. 15, 2010.

* cited by examiner

*Primary Examiner* — George Wyszomierski
(74) *Attorney, Agent, or Firm* — Paul J. DiConza

(57) ABSTRACT

An amorphous magnetic alloy is presented. The alloy has the general formula: $(Fe_{1-x}Co_x)_nMo_aP_bB_cC_dSi_e$, wherein n is the atomic percent of iron and cobalt; x is the fraction of n; a, b, c, d and e are the atomic percent of molybdenum, phosphorous, boron, carbon and silicon respectively and n, x, a, b, c, d and e are defined by following relationship: $76 \leqq n \leqq 85$; $0.05 < x \leqq 0.50$; $0 \leqq a \leqq 4$; $b \geqq 10$; $0 \leqq c < d$; and $0.1 \leqq e \leqq 2$. Articles comprising the alloy and methods employing the alloy for making articles are also presented.

10 Claims, 4 Drawing Sheets

AMORPHOUS MAGNETIC ALLOYS, ASSOCIATED ARTICLES AND METHODS

STATEMENT REGARDING FEDERALLY SPONSORED RESEARCH & DEVELOPMENT

This invention was made with Government support under contract number N00014-07-C-0550 awarded by U.S. Office of Naval Research. The Government has certain rights in the invention.

BACKGROUND

The invention relates generally to amorphous magnetic alloys. More particularly, the invention relates to amorphous magnetic alloys with high saturation magnetization and good thermal stability. The invention further relates to a magnetic component using such alloys and methods for making the magnetic component.

Development of amorphous soft magnetic materials is important to the development of high performance power electronic devices. Amorphous magnetic materials used for applications such as a core of a transformer, an inductor, etc., are typically an iron-based or cobalt-based amorphous alloy (also referred to as metallic glasses). Typically, cores for electric devices are arranged to form a stack or a coil. These stacks or coils are then cut into desired shapes to be employed in the core.

Conventional metallic glasses include Fe—P—C-based metallic glasses first produced in the 1960s, (Fe, Co, Ni)—P—B-based alloy, (Fe, Co, Ni)—Si—B-based alloy, (Fe, Co, Ni)—(Zr, Hf, Nb)-based alloy, and (Fe, Co, Ni)—(Zr, Hf, Nb)—B-based alloy, produced in the 1970s. Most of these alloys are typically subjected to a rapid solidification process, that is, cooling the molten alloy at a sufficient cooling rate to a temperature below a glass transition temperature to suppress crystallization and produce an amorphous alloy. Amorphous alloys generally are prepared with small dimensions. However, the currently employed processes, such as melt spinning, often are subject to process limitations that prevent producing articles with desired dimensions.

The amorphous magnetic alloys exhibit a glass transition at a temperature below a crystallization temperature, with a supercooled liquid region defined as the temperature range between the glass transition temperature and the crystallization temperature. The supercooled liquid region is generally considered to be related to the stability of amorphous phase. Accordingly, the alloys having a wide supercooled liquid region are considered to be excellent in glass-forming ability, which has been further related to good thermal stability of the amorphous phase. Glass-forming ability is required to produce articles with desired shape and dimension from the amorphous magnetic alloy.

U.S. Pat. No. 7,223,310 and U.S. Pat. No. 7,357,844 disclosed a soft magnetic Fe—B—Si-based metallic glass alloy composition exhibiting clear glass transition, wide supercooled liquid region, and having high glass-forming ability and saturation magnetization. However, magnetic properties of such alloys are typically, not stable when the alloys are subjected to thermal processing. Thermal processing may be required to form the alloys into desired geometric shapes.

Thus, there is a need to provide an improved amorphous magnetic alloy having good glass-forming ability and good thermal stability while maintaining the desired balance of magnetic properties. There is a further need for an article having a magnetic component with improved properties as compared to conventional magnetic components. Moreover, there is a need for methods to produce such amorphous magnetic alloys and articles of desired dimensions.

BRIEF DESCRIPTION

One embodiment of the present invention provides an amorphous magnetic alloy having the general formula: $(Fe_{1-x}Co_x)_nMo_aP_bB_cC_dSi_e$, wherein n is the atomic percent of iron and cobalt; x is the fraction of n; a, b, c, d and e are the atomic percent of molybdenum, phosphorous, boron, carbon and silicon respectively, wherein n, x, a, b, c, d and e are defined by following relationship:

$$76 \leqq n \leqq 85$$

$$0.05 < x \leqq 0.50;$$

$$0 \leqq a \leqq 4;\ b \geqq 10;$$

$$0 \leqq c < d;\ \text{and}$$

$$0.1 \leqq e \leqq 2.$$

Another embodiment is an article comprising a magnetic component made of the amorphous magnetic alloy of the present invention.

Yet another embodiment of the present invention provides a method of making an article. The method includes the steps of providing the amorphous magnetic alloy of the present invention and processing the alloy within a supercooled liquid region of the alloy.

DETAILED DESCRIPTION

Figure 1:
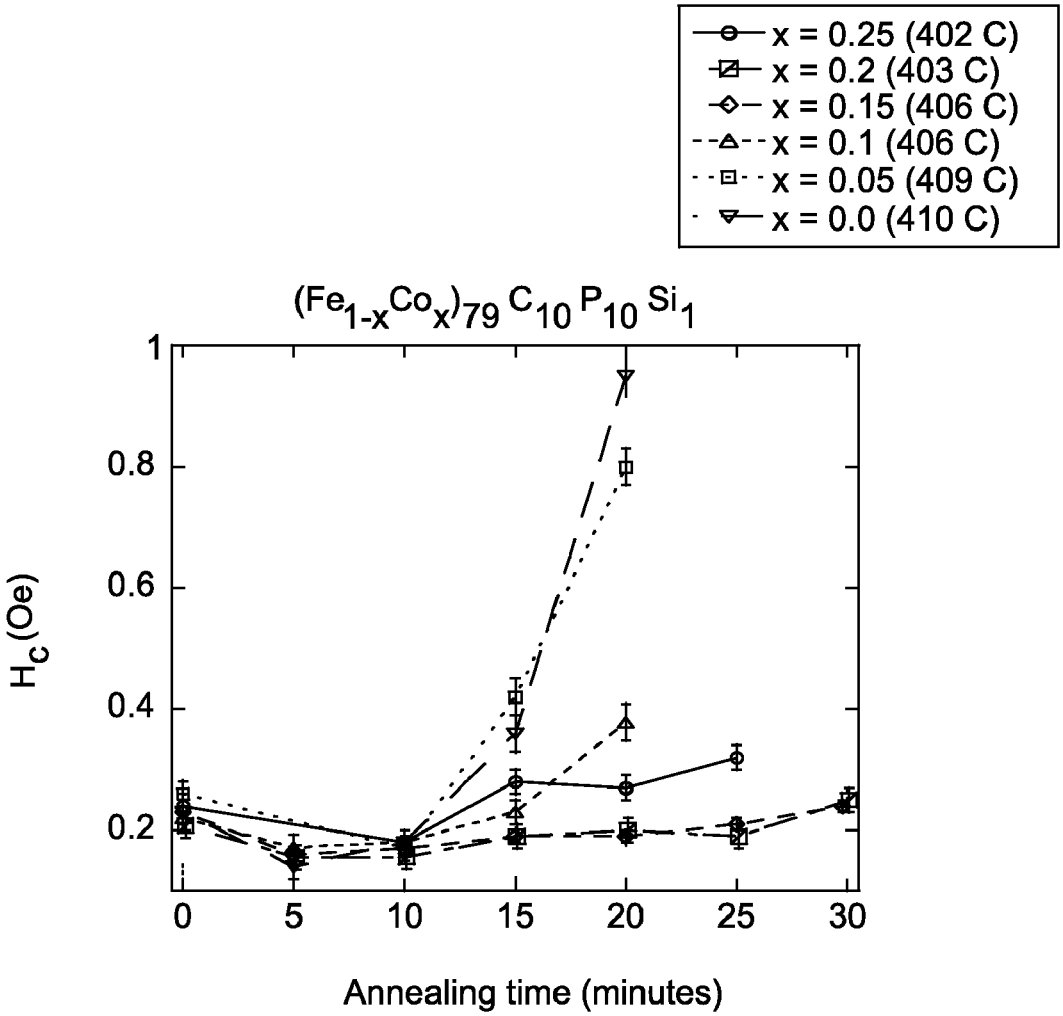
FIG. 1 shows comparative graphs of saturation magnetization as a function of annealing time for inventive alloys 1, 2, 3, 4 and comparative alloys 1 and 2 as per Table 1, according to an embodiment of the present invention.

As discussed in detail below, embodiments of the present invention include amorphous magnetic alloys (also referred as alloys or alloy compositions) having a good balance of magnetic properties, and thermal stability, and an article (magnetic component) made of such amorphous magnetic alloys.

In the following specification and the claims that follow, the singular forms "a," "an," and "the" include plural referents unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about" or "substantially," may not be limited to the precise value specified, and may include values that differ from the specified value. In at least some instances, the approximating language may correspond to the precision of an instrument for measuring the value.

For purposes of this invention, an amorphous magnetic alloy (metallic glass alloy) is defined as a magnetic material, where a continuous matrix phase has an amorphous nature, i.e. a disordered atomic-scale structure that does not have long-range crystallographic order. The amorphous magnetic alloy may also include crystalline phases within the amorphous matrix.

As used herein, the term "crystallization temperature" ($T_x$) refers to the transition temperature at which the alloy changes, upon heating, from the amorphous state to the crystallization state. The alloy, according to one embodiment of the invention, may have crystallization temperature in a range from about 400 degrees Celsius to about 550 degrees Celsius.

As used herein, the term "glass-transition temperature" ($T_g$) refers to the transition temperature at which the alloy transforms from viscous liquid into an amorphous phase. This transformation usually occurs upon rapid cooling.

The term "supercooled liquid region" as used herein refers to a temperature interval ($\Delta T_X$) defined by the difference between the crystallization temperature ($T_x$) and the glass transition temperature ($T_g$): ($\Delta T_x = T_x \sim T_g$).

As known by those skilled in the art, an amorphous alloy transforms to a crystalline alloy when heated to a crystallization temperature. A change in magnetic properties such as coercivity and initial permeability of the amorphous magnetic alloy occurs, however, when the alloy is subjected to elevated temperatures considerably lower than the crystallization temperature. In other words, the thermal stability of the magnetic properties of the amorphous magnetic alloy is generally very poor. Usually, the alloys are stable for only a few minutes when heated to a temperature in the supercooled liquid region, resulting in large changes in properties such as coercivity, and thus allowing very little time for processing the alloy into a desired shape or form.

As used herein, the term "coercivity" refers to the magnetic field required to reduce the external magnetization of a ferromagnetic substance to zero. Furthermore, a change in coercivity from the as-rapidly solidified alloy value can be used as a measure of thermal stability of the amorphous magnetic alloys. The change in coercivity of an alloy is measured as a function of time at an elevated temperature to determine thermal stability of the alloy.

As used herein, the term "thermal stability" of the amorphous magnetic alloy refers to the ability of the alloy to retain its magnetic properties, such as coercivity, during exposure to elevated temperatures. This stability in magnetic characteristics is believed to be attributable to the ability of the amorphous phase to persist in the alloy during elevated temperature exposure. Conventionally, the thermal stability has been, generally, correlated to the supercooled liquid region for such alloys. However, according to an embodiment of the invention, while performing research on various amorphous magnetic alloy compositions, it was found that the size of the supercooled liquid region is not necessarily a good measure of the thermal stability. Instead, "time to crystallize" or "crystallization time" is a more important alloy property.

As used herein the term "crystallization time" may be determined by isothermally annealing the alloys in the supercooled liquid region and monitoring the time required for the amorphous phase to begin to develop long-range order, which can be evidenced by a combination of X-ray diffraction spectrum changes, onset of brittleness and increase in the coercivity of the alloy.

Embodiments of the present invention provide an amorphous magnetic alloy expressed by the general formula:

$$(Fe_{1-x}Co_x)_n Mo_a P_b B_c C_d Si_e,$$

wherein n+a+b+c+d+e=100; n is the atomic percent of iron and cobalt; x is the fraction of n; a, b, c, d and e are the atomic percent of molybdenum, phosphorous, boron, carbon and silicon respectively, wherein n, x, a, b, c, d and e are defined by following relationship:

$$76 \leqq n \leqq 85$$

$$0.05 < x \leqq 0.50;$$

$$0 \leqq a \leqq 4;\ b \geqq 10;$$

$$0 \leqq c < d;\ \text{and}$$

$$0.1 \leqq e \leqq 2$$

In the above alloy of the present invention, the alloy composition comprises a selection of ferromagnetic transition metals (Fe and Co), non-magnetic transition metals (Mo) and metalloid elements (B, C, P and Si).

The metalloid elements tend to promote the formation of an amorphous phase and are chosen to increase the number of equilibrium phases. The thermodynamic competition between the equilibrium crystalline phases slows down the crystallization kinetics, allowing the amorphous phase to be maintained during solidification. However, a consequence of the presence of the metalloid elements is that the saturation magnetization of the alloy is reduced. Thus, glass-forming ability of the alloy can be increased at the cost of magnetic properties.

Table 1 shows the respective alloy compositions of inventive alloys 1 to 13 and comparative alloys 1 to 10, and their respective saturation magnetization ($M_s$), coercivity ($H_c$), supercooled liquid region ($\Delta T_X$) and crystallization time or time to crystallize (t). Ribbon samples of each composition were investigated for their magnetic properties and thermal behavior. A method of making ribbon samples is discussed below. X-ray diffraction measurements were employed to distinguish the amorphous and crystalline state of the alloy.

Furthermore, these samples were annealed within the supercooled liquid region at a temperature 20 degree Celsius below the crystallization temperature of the corresponding alloy. Coercivity of each sample was measured as a function of annealing time at this annealing temperature. In a preferred embodiment, the alloys have a coercivity value the same or lower than the as-cast coercivity value for times in excess of 10 minutes.

In the alloy compositions, the ferromagnetic transition metals such as Fe, Co, and Ni, provide saturation magnetization and soft magnetic characteristics. The alloy composition includes an amount of the ferromagnetic transition metals (Fe and Co) (n) ranging from about 76 to about 85 atomic percent. The element Co is substituted for a fraction of Fe depending on desired saturation magnetization and thermal stability. A preferred ratio of Fe and Co to maximize saturation magnetization and thermal stability may, also, depend on the presence and concentration of the metalloid elements.

The fraction of the element Co (x) in the ferromagnetic transition metal component is in a range from about 0.05 to about 0.50 of ferromagnetic elements. Moreover, the presence of Co in an amount greater than a fraction of about 0.10 of ferromagnetic elements substantially increases the thermal stability of the amorphous phase of the alloy. In one embodiment, depending on the ratios of the metalloid elements, the saturation magnetization of the alloy is a maximum for Co fraction (x) ranging from about 0.15 to about 0.35 of ferromagnetic elements.

Furthermore, it was observed that Co substitution lowers the crystallization temperature ($T_x$), while increasing the crystallization time, in one embodiment. For example, comparative alloy 1 without Co has $\Delta T_x$=20° C. and the crystallization time is less than 10 minutes, while substituting Fe with Co in inventive alloys 1, 2, 3, 4 showed increased $\Delta T_x$ and crystallization time, as evident in Table 1. These observations are further evident by a graph shown as FIG. 1. The graph shows change in coercivity of the alloy $(Fe_{1-x}Co_x)_{79}C_{10}P_{10}Si_1$ for x=0, 0.05, 0.1, 0.15, 0.2 and 0.25 with annealing time.

According to one embodiment of the invention, the non-magnetic transition metal, Mo, is added as a glass former due to its relatively large atomic diameter. Mo may be substituted for both Fe and Si. In one embodiment, the amount of Mo, (a), may be substituted in a range from about 0 to about 4 atomic percent. In certain embodiments, the amount of Mo may be substituted in a range from about 0 to about 2 atomic percent, and in particular embodiments, to about 1 atomic percent. For example, inventive alloy 9 shows a good balance of magnetic properties and thermal stability as shown in Table 1. The inventive alloy 9 is stable for about 15 minutes as illustrated in graph of FIG. 2.

Figure 2:
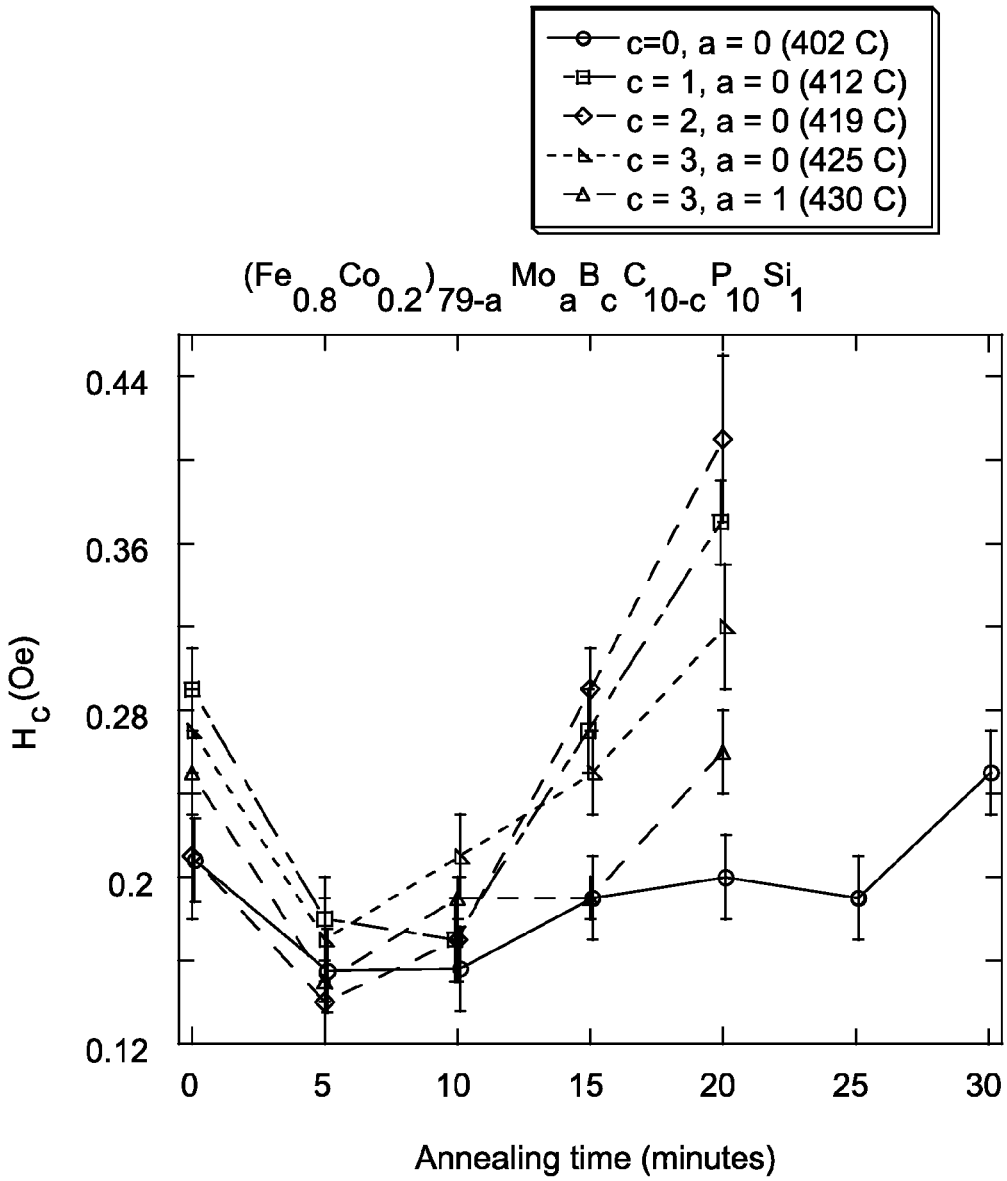
FIG. 2 shows comparative graphs of saturation magnetization as a function of annealing time for inventive alloys 3, 5, 6, 7 and 9 as per Table 1, according to another embodiment of the present invention.

The ratios of the metalloid elements (B, P, C and Si) may be adjusted to optimize alloy properties, such as glass-forming ability and thermal stability. Substitution of B for C tends to increase the saturation magnetization ($M_s$), but tends to reduce the thermal stability. The significant effect of B is evidenced by change in coercivity with annealing time of the inventive alloys 5, 6, and 7 as shown in FIG. 2. In one embodiment, the alloy may or may not include B. In another embodiment, the amount of B (c) is less than the amount of C (d).

It was observed that the addition of P tended to have a significant effect on the thermal stability of the alloy. The alloys with higher amount of P (b) are thermally stable for longer times. The addition of P promotes a large number of stable and metastable phases, which tend to retard the crystallization kinetics. In one embodiment, the amount of P (b) is at least about 10 atomic percent.

Figure 3:
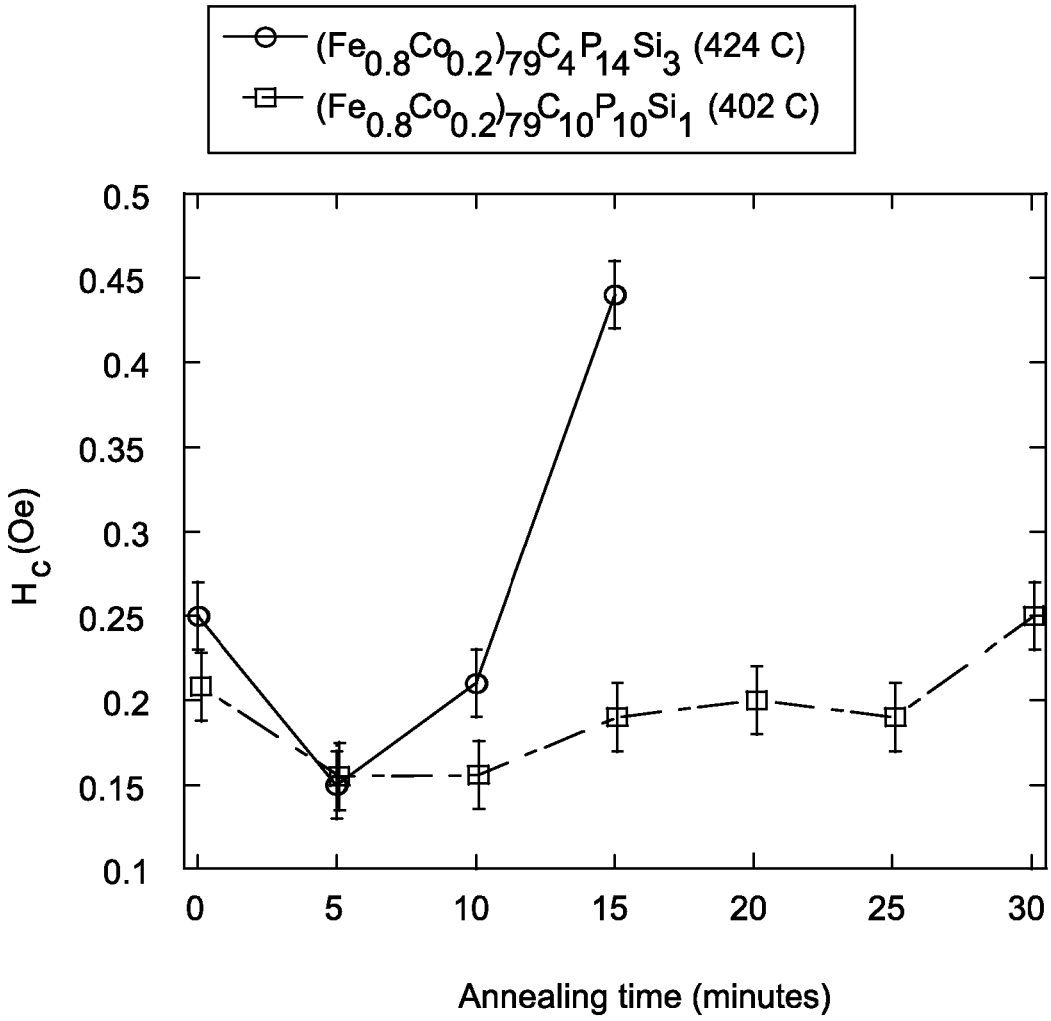
FIG. 3 shows comparative graphs of saturation magnetization as a function of annealing time for inventive alloy 3 and comparative alloy 3 as per Table 1, according to yet another embodiment of the present invention.

The amount of P (b) and amount of C (d) can be selected to provide a desired level of the metalloid elements. In one embodiment, the combined amount of P and C, (b+d), is at least about 15 atomic percent. In another embodiment, (b+d) varies from about 15 atomic percent to about 20 atomic percent. Furthermore, the ratio of the amount of P and the amount of C (b:d) can be helpful to balance magnetic properties and thermal stability. In one embodiment, the ratio (b:d) varies from about 8:12 to about 12:8. In a preferred embodiment, the ratio (b:d) is 1:1. For example, the inventive alloys 1, 2, 3, 4 having the ratio b:d of 10:10, exhibit a good balance of saturation magnetization and thermal stability as shown in Table 1 and FIG. 1. In contrast, comparative alloy 3 having the ratio of (b:d) of 4:14 showed lower saturation magnetization. Furthermore, a graph in FIG. 3 shows a comparative study of inventive alloy 3 and comparative alloy 3 with respect to their thermal stability. It is clear from the graph that change in coercivity of the comparative alloy 3 is relatively large on annealing even for 10 minutes and very large on annealing for about 15 minutes.

Figure 4:
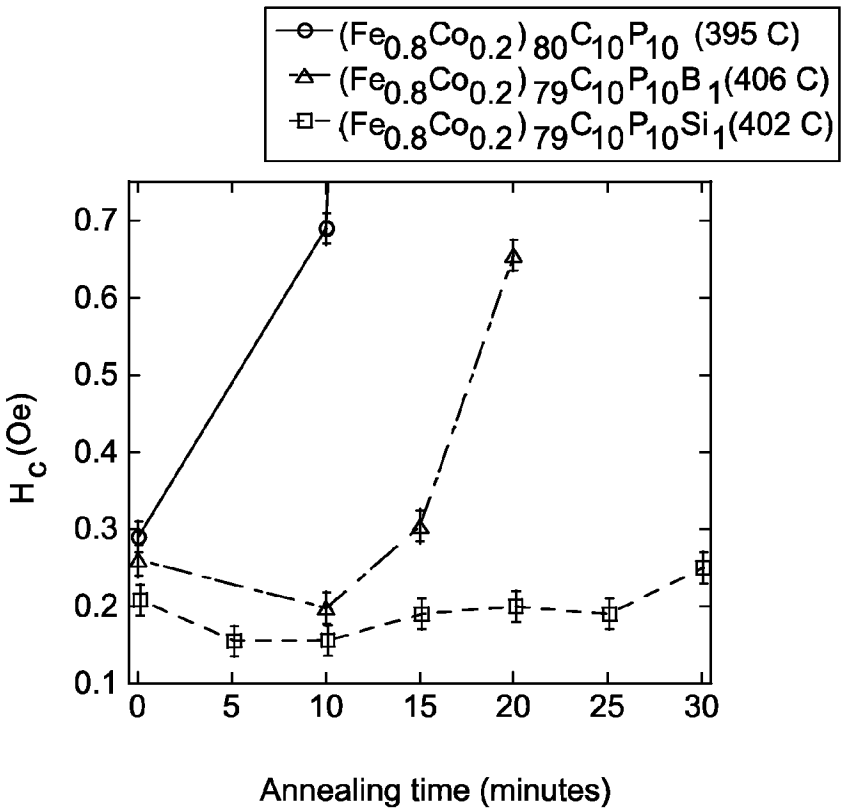
FIG. 4 shows comparative graphs of saturation magnetization as a function of annealing time for inventive alloy 3 and comparative alloy 4 and 5 as per Table 1, according to yet another embodiment of the present invention.

In addition, the presence or the absence of Si may affect the thermal stability. Removing Si or substituting ferromagnetic transition metals with any other metalloid elements, for example B, resulted in an increase in saturation magnetization but a decrease in thermal stability as shown in Table 1. Effects of absence and presence of Si on thermal stability are further evidenced by a graph shown in FIG. 4. It is clear from the graph that comparative alloys 4 and 5, the alloys for e=0, that is without Si, are not thermally stable. However, substitution of Si for the ferromagnetic transition metals or for the metalloid elements in small quantity, for example as in inventive alloy 2 with e=1, results a good balance of saturation magnetization and thermal stability of the alloy.

Figure 5:
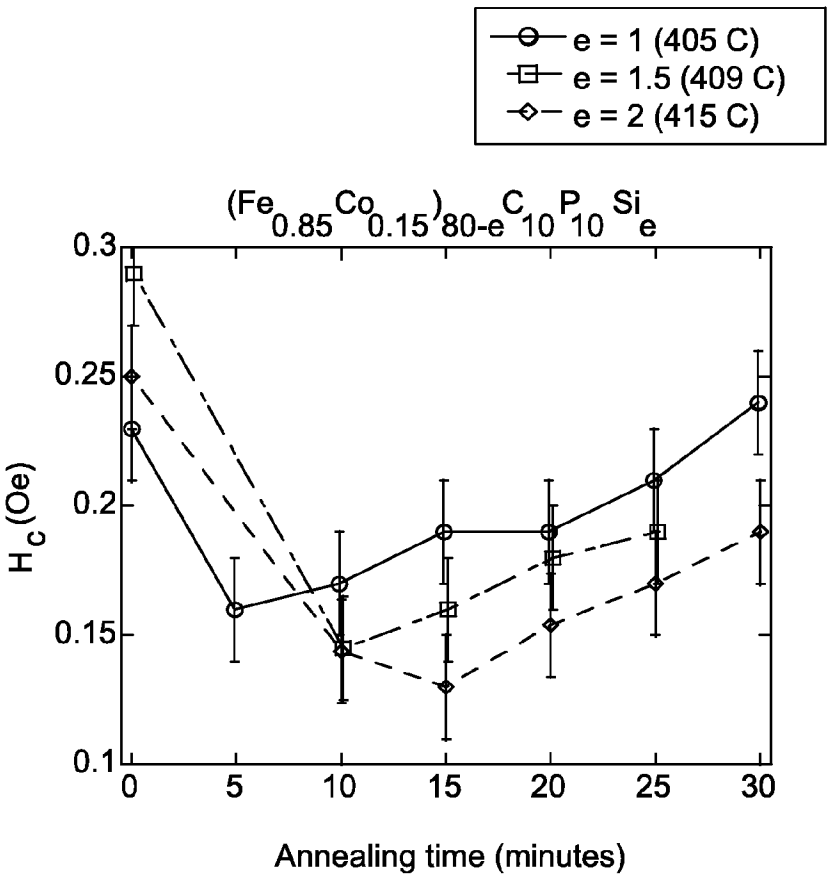
FIG. 5 shows comparative graphs of saturation magnetization as a function of annealing time for inventive alloys 2, 10 and 11 as per Table 1, according to yet another embodiment of the present invention.

In one embodiment, the amount of Si (e) varies from about 0.1 to about 2.0 atomic percent. In certain embodiments, the amount of Si (e) varies from about 1.0 to about 1.5 atomic percent. Increasing the amount of Si (e) beyond about 1.5 atomic percent, the alloy shows further increase in the thermal stability but a decrease in the saturation magnetization as shown by inventive alloys 10 and 11 in Table 1. FIG. 5 illustrates a graph showing change in coercivity with annealing time of alloys $((Fe_{0.8}Co_{0.2})_{80-e}C_{10}P_{10}Si_e)$ with increasing amount of Si (e).

Furthermore, for high amount of Si (e), for example e=3, comparative alloys 3 and 8 showed reduced thermal stability. The comparative alloy 3 is stable for less than about 10 minutes as evident from Table 1 and FIG. 3.

Notably, the amorphous magnetic alloys of the compositions described above, have a very good balance of magnetic and thermal properties. Furthermore, it was observed from the above-discussed studies that crystallization kinetics is not coupled to the range of the supercooled liquid region of the alloy. For example, some of the comparative alloys have substantially similar large supercooled liquid regions ($\Delta T_X$) relative to those of the inventive alloys, while having crystallization times less than 10 minutes and thus exhibiting poor thermal stability as compared to the inventive alloys. On the other hand, some of the inventive alloys having a narrow supercooled liquid region exhibit very good thermal stability with increased crystallization time, relative to comparative alloys.

Embodiments of the present invention provide an article including a magnetic component. The magnetic component is made of an amorphous magnetic alloy having the composition as described above.

The amorphous magnetic alloy may be very suitable for magnetic components, such as a magnetic core, a magnetic head, a magnetic shield, an electromagnet, and the like. In certain embodiments, the magnetic component is a magnetic core. Various forms of the core include a ribbon or tape-wound core, a wire-wound core, or a powder core. A tape-wound core may be formed of an amorphous magnetic alloy ribbon or tape wrapped concentrically around a preform, such as a cylindrical bobbin. A wire wound core is formed of amorphous magnetic alloy wire wrapped around a preform.

As used herein, the term "magnetic core" refers to a piece of magnetic material with a high permeability used to confine and guide magnetic fields in electrical and electromechanical devices such as electromagnets, transformers, electric motors and inductors. The high permeability, relative to the surrounding air, causes the magnetic field lines to be concentrated in the magnetic core. The magnetic field is, often, created by a coil around a core that carries a current. The presence of the core can increase the magnetic field of a coil by a factor of several thousand over what it would be without the core.

As known to those skilled in the art, each form of the magnetic component may be constructed in a variety of shapes selected from the group consisting of a toroidal core, a C-core, an E-core, a D-core, a pot core, a ring core, a planar core or a bar core. These magnetic components can be employed in a transformer, an inductor, a filter, a choke, a solenoid, a generator, a motor or a fluxgate.

According to an embodiment of the invention, a method of making an article is provided. The method includes the steps of providing the amorphous magnetic alloy having the composition described previously, and processing the alloy within a supercooled liquid region of the alloy. The processing of the alloy may further include thermal treatment.

In one embodiment, providing the amorphous magnetic alloy includes forming the alloy by using a casting process. Examples of casting process include, but are not limited to, melt-spinning, melt extraction, injection casting, and die-casting.

As discussed above, on heating the alloy within the supercooled liquid region, the amorphous magnetic alloy takes some time to crystallize. This "crystallization time" provides a time for processing the alloy to form desired geometrical shapes before magnetic properties of the alloy are degraded.

Various techniques for processing the alloy include, but are not limited to powder processes, thermo-mechanical techniques, heat treatment, vapor deposition processes or a combination thereof. Non-limiting examples of thermo-mechanical techniques include forging, extruding, rolling, hot pressing, swaging, drawing and powder compaction.

EXAMPLES

Amorphous magnetic alloy samples were made by initially producing ingots of about 10 g by arc-melting a mixture of pre-alloyed $Fe_3P$, $Fe_3B$, $Fe_3C$ together with the other elements—Co, Mo and Si, in their elemental form under a Ti-gettered Ar atmosphere in a water-cooled copper crucible. Ribbon samples of different compositions were made by the melt-spinning technique under a partial He atmosphere. The tangential wheel speed was approximately 40 m/s and produced ribbons of approximately 20 μm in thickness.

The amorphous nature of the melt-spun ribbons was confirmed by X-ray diffraction with Cu $K_\alpha$ radiation. Thermal behavior of the samples was investigated in a differential scanning calorimeter at a constant heating rate of 10° C./s. Magnetic properties were characterized using a vibrating sample magnetometer (VSM). The VSM had a maximum applied field of 1.8 T and field resolution of 0.01 Oe. Typically, a magnetic field of ~0.03 T was sufficient to reach saturation magnetization for the samples investigated. Thermal stability was investigated by determining crystallization time for each sample by isothermally annealing the alloys within their respective supercooled liquid region, about 20 degrees Celsius below the measured crystallization temperature ($T_x$) for each composition. Annealing temperatures for the compositions are represented in the corresponding graphs in parentheses.

Example 1

Amorphous magnetic alloys according to the present invention having the compositions $(Fe_{1-x}Co_x)_{79}C_{10}P_{10}Si_1$ for x=0.0, 0.05, 0.1, 0.15, 0.2 and 0.25 were produced by the above described procedure. The saturation magnetization of each of the alloy compositions is shown in Table 1. These alloys were annealed for about 30 minutes at a temperature within their respective supercooled liquid region, about 20 degrees Celsius below the measured crystallization temperature ($T_x$) for each composition. The change in coercivity of the alloys during annealing is shown in FIG. 1. Annealing temperatures for the compositions for x=0.0, 0.05, 0.1, 0.15, 0.2 and 0.25, are 410° C., 409° C., 406° C., 406° C., 403° C. and 402° C. respectively, (also shown in FIG. 1). It is clear from the graph that the alloy compositions with Co content x=0 and 0.05 were found to be thermally stable for less than about 10 minutes, while the alloy composition with Co content x=0.1 was thermally stable for about 10 minutes and the alloy compositions with Co content x=0.15, 0.2 and 0.25 were thermally stable for about 30 minutes.

Example 2

Amorphous magnetic alloy according to the present invention having the composition $(Fe_{0.8}Co_{0.2})_{78}Mo_1B_3C_7P_{10}Si_1$ was produced by the above described procedure. The saturation magnetization the alloy composition is shown in Table 1. This composition was annealed at about 430 degrees Celsius for about 20 minutes. The change in coercivity of the alloy during annealing is shown in FIG. 2. The alloy composition was found to be thermally stable for about 15 minutes at 430 degrees Celsius which is within the supercooled liquid region, about 20 degrees Celsius below the measured crystallization temperature ($T_x$) for this amorphous magnetic alloy composition.

Example 3

Amorphous magnetic alloys according to the present invention having the compositions $(Fe_{0.8}Co_{0.2})_{79}B_cC_{10-c}P_{10}Si_1$ for c=1, 2 and 3 were produced by the above-described procedure. The saturation magnetization of each of the alloy compositions is shown in Table 1. These alloys were annealed at a temperature within their respective supercooled liquid region about 20 degrees below the measured crystallization temperature ($T_x$) for each composition. The change in coercivity of the alloys during annealing is shown in FIG. 2. Annealing temperatures for the compositions for c=1, 2 and 3 are 412° C., 419° C., and 425° C. respectively, (also shown in FIG. 2). The alloy compositions for c=1 and 2 were found to be thermally stable for about 10 minutes and for c=3 was found to be stable for about 15 minutes as evident in FIG. 2.

Example 4

The amorphous magnetic alloys according to the present invention having the compositions $(Fe_{0.85}Co_{0.15})_{80-e}C_{10}P_{10}Si_e$ for e=1, 1.5 and 2 were produced by the above-described procedure. The saturation magnetization of each of the alloy compositions is shown in Table 1. These alloys were annealed at a temperature within their respective supercooled liquid region about 20 degrees below the measured crystallization temperature ($T_x$) for each composition. Annealing temperatures for the compositions for e=1, 1.5 and 2 are 405° C., 409° C., and 415° C. respectively, (also shown in FIG. 5). The change in coercivity of the alloys during annealing is shown in FIG. 5. These alloy compositions were found to be thermally stable for more than about 25 minutes.

Example 5

The amorphous magnetic alloys according to the present invention having the compositions $(Fe_{0.8}Co_{0.2})_{78.5}C_{10}P_{10}Si_{1.5}$ and $(Fe_{0.75}Co_{0.25})_{78.5}C_{10}P_{10}Si_{1.5}$ were produced by the above-described procedure. The saturation magnetization of each of the alloy composition is shown in Table 1. These alloys were annealed at a temperature within their respective supercooled liquid region about 20 degrees below the measured crystallization temperature ($T_x$) for each composition. These alloy compositions were found to be thermally stable for more than about 20 minutes.

While only certain features of the invention have been illustrated and described herein, many modifications and changes will occur to those skilled in the art. It is, therefore, to be understood that the appended claims are intended to cover all such modifications and changes as fall within the true spirit of the invention.

TABLE 1

| Alloys | Compositions | Saturation Magnetization (as-cast) (Tesla) | Coercivity (as-cast) (Oe) | Supercooled liquid region (DeltaTx) | Time to Crystallize Or Crystallization time |
|---|---|---|---|---|---|
| Inventive Alloy 1 | $(Fe_{0.9}Co_{0.1})_{79}C_{10}P_{10}Si_1$ | 1.52 | 0.22 | 26 | ≧15 min |
| Inventive Alloy 2 | $(Fe_{0.85}Co_{0.15})_{79}C_{10}P_{10}Si_1$ | 1.50 | 0.23 | * | ≧25 min |
| Inventive Alloy 3 | $(Fe_{0.8}Co_{0.2})_{79}C_{10}P_{10}Si_1$ | 1.48 | 0.22 | 40 | ≧20 min |
| Inventive Alloy 4 | $(Fe_{0.75}Co_{0.25})_{79}C_{10}P_{10}Si_1$ | 1.46 | 0.24 | * | ≧10 min |
| Inventive Alloy 5 | $(Fe_{0.8}Co_{0.2})_{79}B_1C_9P_{10}Si_1$ | 1.49 | 0.29 | * | ≧10 min |
| Inventive Alloy 6 | $(Fe_{0.8}Co_{0.2})_{79}B_2C_8P_{10}Si_1$ | 1.50 | 0.21 | * | ≧10 min |
| Inventive Alloy 7 | $(Fe_{0.8}Co_{0.2})_{79}B_3C_7P_{10}Si_1$ | 1.49 | 0.27 | 40 | ≧15 min |
| Inventive Alloy 8 | $(Fe_{0.8}Co_{0.2})_{79}C_8P_{12}Si_1$ | 1.46 | 0.19 | * | ≧20 min |
| Inventive Alloy 9 | $(Fe_{0.8}Co_{0.2})_{78}Mo_1B_3C_7P_{10}S_1$ | 1.44 | 0.25 | 40 | ≧15 min |
| Inventive Alloy 10 | $(Fe_{0.85}Co_{0.15})_{78.5}C_{10}P_{10}Si_{1.5}$ | 1.48 | 0.29 | * | ≧25 min |
| Inventive Alloy 11 | $(Fe_{0.85}Co_{0.15})_{78}C_{10}P_{10}Si_2$ | 1.43 | 0.25 | * | ≧25 min |
| Inventive Alloy 12 | $(Fe_{0.8}Co_{0.2})_{78.5}C_{10}P_{10}Si_{1.5}$ | 1.45 | 0.26 | 35 | ≧20 min |
| Inventive Alloy 13 | $(Fe_{0.75}Co_{0.25})_{78.5}C_{10}P_{10}Si_{1.5}$ | 1.43 | 0.28 | * | ≧20 min |
| Comparative Alloy 1 | $Fe_{79}C_{10}P_{10}Si_1$ | 1.49 | 0.23 | 20 | <10 min |
| Comparative Alloy 2 | $(Fe_{0.95}Co_{0.05})_{79}C_{10}P_{10}Si_1$ | 1.51 | 0.26 | 23 | <10 min |
| Comparative Alloy 3 | $(Fe_{0.8}Co_{0.2})_{79}C_4P_{14}Si_3$ | 1.43 | 0.25 | * | <10 min |
| Comparative Alloy 4 | $(Fe_{0.8}Co_{0.2})_{79}C_{10}P_{10}B_1$ | 1.51 | 0.26 | 35 | <10 min |
| Comparative Alloy 5 | $(Fe_{0.8}Co_{0.2})_{80}C_{10}P_{10}$ | 1.52 | 0.29 | * | <10 min |
| Comparative Alloy 6 | $Fe_{78}Mo_1B_{13}P_6Si_2$ | 1.47 | 0.22 | 45 | <10 min |
| Comparative Alloy 7 | $Fe_{78}B_3C_7P_{10}Si_2$ | 1.49 | 0.23 | 40 | <10 min |
| Comparative Alloy 8 | $Fe_{78}B_3C_7P_9Si_3$ | 1.45 | 0.25 | 35 | <10 min |
| Comparative Alloy 9 | $(Fe_{0.8}Co_{0.2})_{78}Mo_4B_5C_5P_7Si_1$ | 1.38 | 0.28 | 29 | <10 min |
| Comparative Alloy | $Fe_{78}Mo_1B_{15}Si_6$ | 1.52 | 0.20 | 50 | <10 min |

*$T_g$ could not be determined due to close proximity of $T_c$ and $T_g$

The invention claimed is:

1. An amorphous magnetic alloy having the general formula:

$$(Fe_{1-x}Co_x)_nMo_aP_bB_eC_dSi_e,$$

wherein n is the atomic percent of iron and cobalt; x is the fraction of n; a, b, c, d and e are the atomic percent of molybdenum, phosphorous, boron, carbon and silicon respectively, wherein n, x, a, b, c, d and e are defined by following relationship:

$$76 \leqq n \leqq 85$$

$$0.15 \leqq x \leqq 0.25;$$

$$0 < a \leqq 2;\ b \geqq 10;$$

$$0 < c < d;\ \text{and}$$

$$0.1 \leqq e \leqq 2.$$

2. The amorphous magnetic alloy of claim 1, wherein d is at least about 5.

3. The amorphous magnetic alloy of claim 1, wherein b and d are defined by following relationship $$b+d \geqq 15.$$

4. The amorphous magnetic alloy of claim 1, wherein e is defined by following relationship:

$$1 \leqq e \leqq 2.$$

5. The amorphous magnetic alloy of claim 1, wherein the amorphous magnetic alloy exhibits a supercooled liquid region and exhibits a crystallization time greater than about 10 minutes when heated to a temperature within the supercooled liquid region.

6. The amorphous magnetic alloy of claim 1, wherein the amorphous magnetic alloy exhibits a supercooled liquid region and exhibits a crystallization time greater than 20 minutes when heated to a temperature within the supercooled liquid region.

7. An article comprising a magnetic component made of an amorphous magnetic alloy having the general formula:

$$(Fe_{1-x}Co_x)_nMo_aP_bB_eC_dSi_e,$$

wherein n is the atomic percent of iron and cobalt; x is the fraction of n; a, b, c, d and e are the atomic percent of molybdenum, phosphorous, boron, carbon and silicon respectively, wherein n, x, a, b, c, d and e are defined by following relationship:

$$76 \leqq n \leqq 85$$

$$0.15 \leqq x \leqq 0.25;$$

$$0 < a \leqq 2;\ b \geqq 10;$$

$$0 < c < d;\ \text{and}$$

$$0.1 \leqq e \leqq 2.$$

8. The article of claim 7, wherein the magnetic component is in the form of a tape wound core, a wire-wound core or a powder core.

9. The article of claim 8, wherein the magnetic component has a shape selected from the group consisting of a toroidal core, a C-core, an E-core, a D-core, a pot core, a ring core, a planar core or a bar core.

10. The article of claim 7, is in form of a transformer, an inductor, a filter, a choke, a solenoid, a generator, a motor or a fluxgate.

* * * * *

UNITED STATES PATENT AND TRADEMARK OFFICE

CERTIFICATE OF CORRECTION

PATENT NO. : 8,313,588 B2
APPLICATION NO. : 12/609391
DATED : November 20, 2012
INVENTOR(S) : Iorio et al.

It is certified that error appears in the above-identified patent and that said Letters Patent is hereby corrected as shown below:

Title Page Item (73), under "Assignee," in the second line of this field, immediately after "NY (US)" please insert -- ; University of Virginia Patent Foundation, Charlottesville, VA (US) --

Signed and Sealed this
First Day of July, 2014

Michelle K. Lee

Michelle K. Lee
*Deputy Director of the United States Patent and Trademark Office*